United States Patent [19]

Bird

[11] Patent Number: 4,830,029

[45] Date of Patent: May 16, 1989

[54] METHOD OF AND APPARATUS FOR STYLING HAIR

[75] Inventor: Raymond F. Bird, London, England

[73] Assignee: Landclass Limited, Hong Kong

[21] Appl. No.: 944,152

[22] Filed: Dec. 18, 1986

[30] Foreign Application Priority Data

Mar. 24, 1986 [GB] United Kingdom ..... 8607210

[51] Int. Cl.[4] ..... A41G 5/00

[52] U.S. Cl. ..... 132/54; 132/53

[58] Field of Search ..... 132/5, 7, 9, 46, 48, 132/53, 54, 55, 105, 47

[56] References Cited

U.S. PATENT DOCUMENTS

| | | | |
|---|---|---|---|
| 513,579 | 1/1894 | Kinzly | 132/54 |
| 794,479 | 7/1905 | Austin | 132/105 |
| 1,608,862 | 11/1926 | Ribardiere | 132/54 |
| 1,627,469 | 5/1927 | Syptroth | 132/54 |
| 1,686,636 | 10/1920 | Oppenheim | 132/53 |
| 2,495,504 | 1/1950 | Behr | 132/48 R |
| 2,620,809 | 12/1952 | Rosen | 132/53 |
| 2,708,941 | 5/1955 | Field | 132/33 R |
| 3,258,016 | 6/1966 | Roepnack | 132/53 |
| 3,280,826 | 10/1966 | Jenkins | 132/5 |
| 3,500,836 | 3/1970 | Jordan | 132/53 |
| 3,628,546 | 12/1971 | En Smiger | 132/53 |

FOREIGN PATENT DOCUMENTS

| | | | |
|---|---|---|---|
| 69951 | 11/1892 | Fed. Rep. of Germany . | |
| 544874 | 3/1925 | France . | |
| 369505 | 7/1964 | France | 132/55 |
| 590430 | 9/1968 | France . | |

*Primary Examiner*—John Weiss

*Attorney, Agent, or Firm*—Panitch Schwarze Jacobs and Nadel

[57] ABSTRACT

Hair of a head of hair is styled by means of apparatus (10) comprising a wire (13) formed into a loop (19) end portions (17) of which are secured to an end portion of a tape (11). An end portion of the tape (11) remote from the loop (19) is formed into a pocket (12). The tape (11) carries a weave of false hair (20). Selected strands of the hair to be styled are inserted through the loop 19 and are rolled by rotating the apparatus (10) on a longitudinal axis of the tape (11). The apparatus is secured to the rolled up strands by inserting a free end portion of the loop (19) into the pocket (12). The false hair (20) thus is secured to the head of hair and may be styled in a conventional manner.

22 Claims, 4 Drawing Sheets

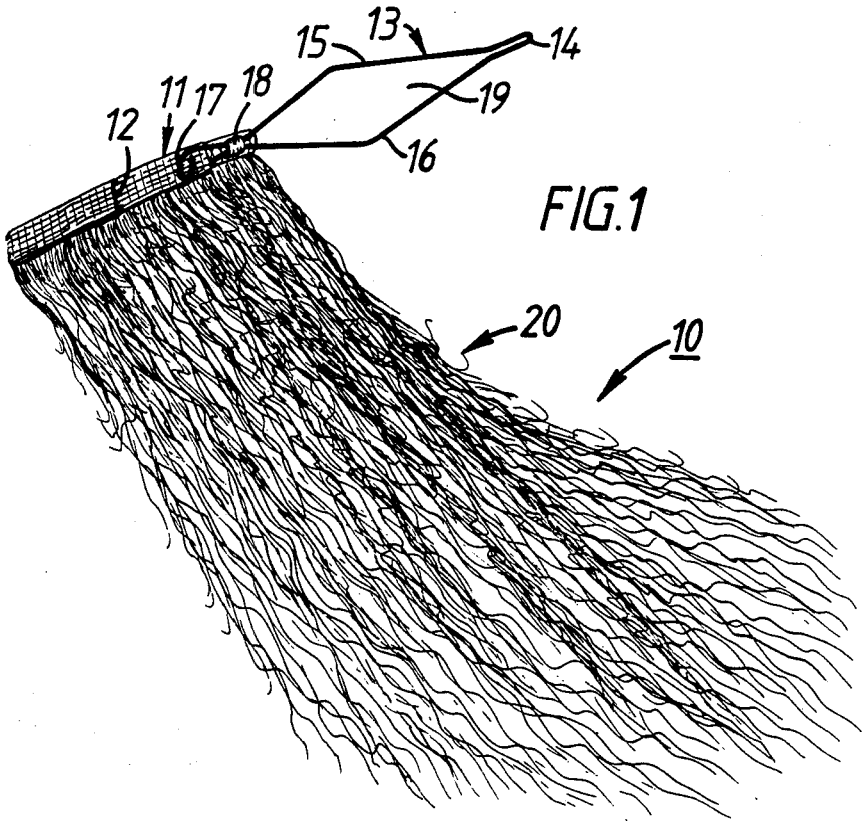
FIG. 1
FIG. 2
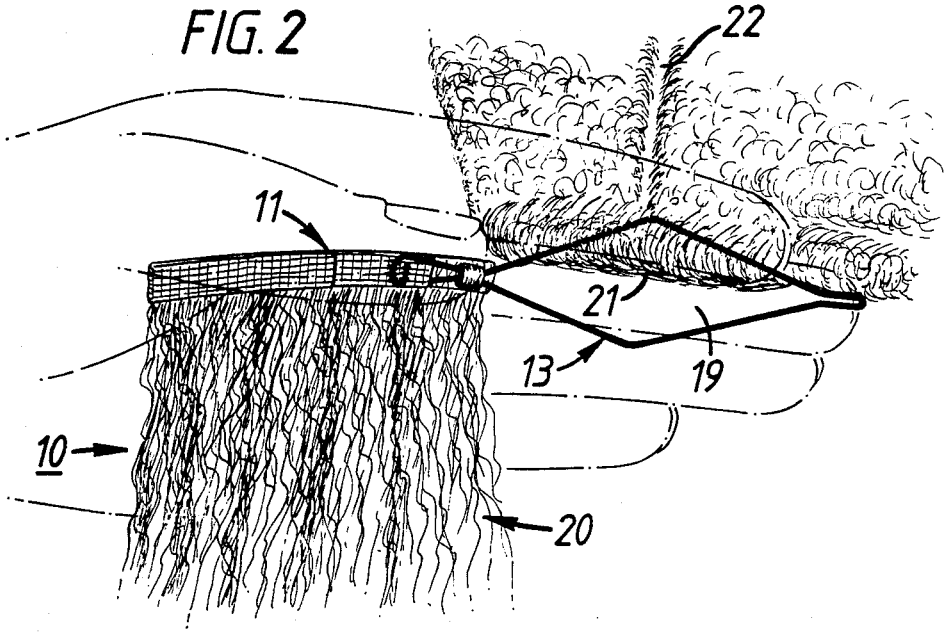

METHOD OF AND APPARATUS FOR STYLING HAIR

This invention relates to a method of and apparatus for styling hair.

In the business of hairdressing there are many techniques for providing a hair style apart from dressing hair of a head in a particular style. For example, a person desiring a hair style may be provided with a wig or a hairpiece or a plurality of weaves of strands of hair each weave being stitched to strands of a head of hair which has previously been prepared by forming the strands into a plurality of canerows. The additional hair comprising the wig, hairpiece or weaves may be treated and styled whereby a person can wear hair in a style which would not normally be available to the person because the characteristics of that person's hair would be such that the hair could not be dressed in the desired style.

However, there are disadvantages with each of these techniques. Wigs are uncomfortable to wear for any length of time; a hairpiece, which generally is used only intermittently, does not cover substantially the whole of a head of hair; and the known process of attaching weaves to a head of hair is time-consuming and, if carried out by a professional hairdresser, expensive.

It is desireable, therefore, to provide a method of styling hair wherein application of a plurality of weaves to a head of hair is less time-consuming than hitherto.

According to the present invention there is provided a method of styling hair including the steps of attaching a support for additional hair to strands of the hair to be styled, rotating the support to form the strands into a roll formation of hair and securing the strands in the roll formation.

Also according to the present invention, there is provided apparatus for styling hair comprising a first component for combining with selected strands of a head of hair to form the strands into a roll formation wherein there is provided a second component carrying strands of additional hair and means for effecting cooperation of the second component and the roll formation such that the strands of additional hair are attached to the head of hair.

The first component may be contiguous with the second component.

The first component may be integral with the second component.

The first and second components may each be elongate and an end portion of one of the components may be united with an end portion of the other of the components such that the second component may be moved towards the first component.

The first component may comprise two portions adapted to engage the selected strands therebetween.

The first component may comprise a wire in the form of a loop.

The said means may be carried by the second component.

The said means may comprise a formation adapted to receive an end portion of the loop.

The formation may comprise a pocket.

Following is a description, by way of example only and with reference to the accompanying drawings, of one method of carrying the invention into effect.

In the drawings:

FIG. 1 is a diagrammatic representation of one embodiment of apparatus for styling hair in accordance with the present invention, FIG. 2 is a diagrammatic representation of a step in the method of styling hair according to the present invention using the apparatus shown in FIG. 1.

Figure 3:
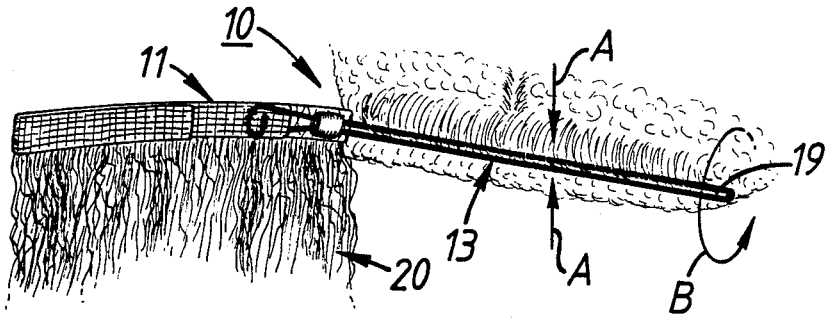
FIG. 3 is a diagrammatic representation of a subsequent step of the method.
Figure 4:
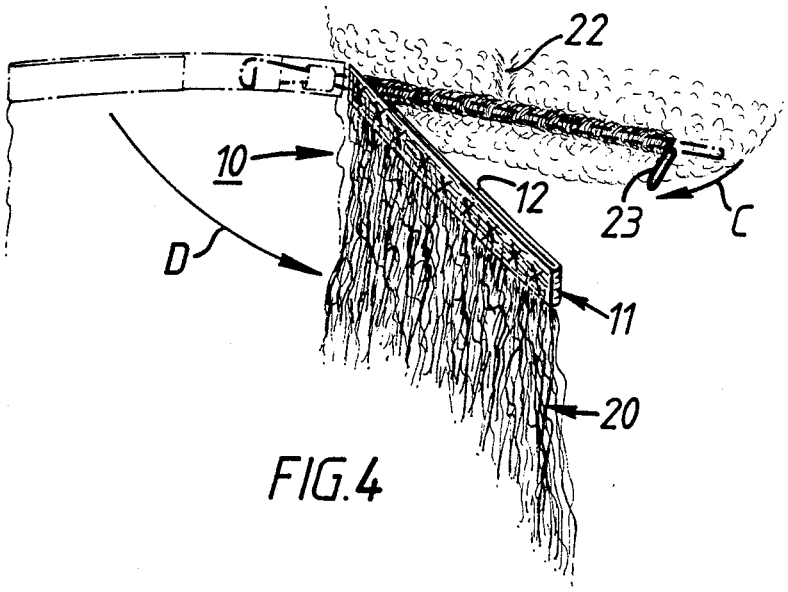
FIG. 4 is a diagrammatic representation of a further step in the method.

Referring now to FIGS. 1 to 5 of the drawings, there is shown apparatus 10 for styling hair comprising a tape 11 an end portion of which is folded upon itself and opposite facing margins of which are stitched one to another to form a pocket 12. An end portion of the tape 11 remote from the pocket 12 has stiched thereto end portions of a plastics coated wire 13 which is bent at its mid-point 14 to form limbs 15,16, end portions of which are curled, as shown at 17. The limbs 15,16 are bound together by a band 18 adjacent the curled end portions 17 such that the portions of the limbs 15,16 extending beyond the tape 11 form a loop 19. The tape 11 has stitched thereto a weave 20 of false hair such that the strands of the weave depend from the tape 11 in a direction substantially transverse to a longitudinal axis of the tape 11.

Figure 5:
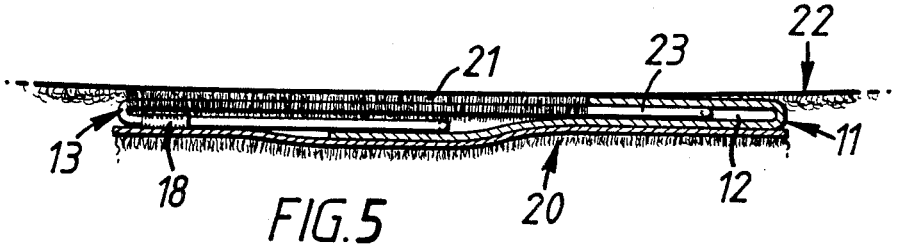
FIG. 5 is a cross section of the apparatus when combined with hair of a head of hair.

In use, selected strands of hair 21 of a head of hair are combed outwardly from a scalp 22 of the head and are guided through the loop 19, as shown in FIG. 2. The loop 19 then is flattened as indicated by the arrows A—A in FIG. 3, so as to engage the strands of hair 21 therebetween and the loop 19 is moved longitudinally of the strands 21 away from the scalp 22 to a location adjacent outer end portions of the strands of hair 21. The flattened loop 19 is then rotated, as indicated by the arrow B in FIG. 3, thereby rotating the whole of the apparatus 10 on a longitudinal axis of the flattened loop 19 such that the strands of hair 21 engaged between the limbs 15 and 16 of the loop 19 are rolled up against the scalp 22. The portions of the wire 13 extending from opposite ends of the rolled up hair are bent towards one another, as indicated by the arrows C,D in FIG. 4, with a result that the portion of the tape 11 carrying the weave 20 is positioned substantially parallel to the flattened loop 19. An end portion of the loop 23 then is inserted in the pocket 12 and the whole wire 13 is manipulated so as to conform substantially with the content of the scalp adjacent the rolled up hair 21, as shown in FIG. 5.

The effect is to form the apparatus such that the false hair of the weave 20 and the apparatus 10 attached thereto are firmly secured with respect to the scalp 22.

Figure 6:
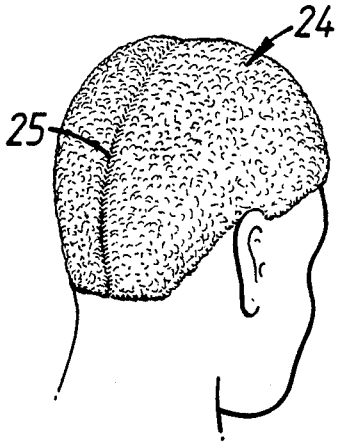
FIGS. 6 to 12 are diagrammatic representations showing successive stages of a head of hair being progressively styled by means of the method according to the invention and using the apparatus according to the invention.
Figure 7:
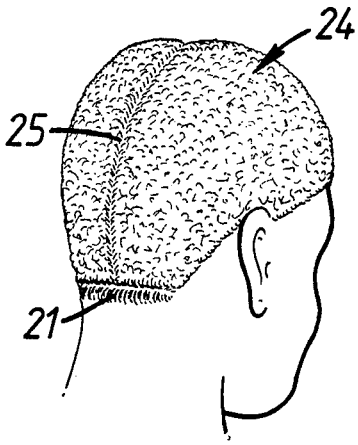
Figure 8:
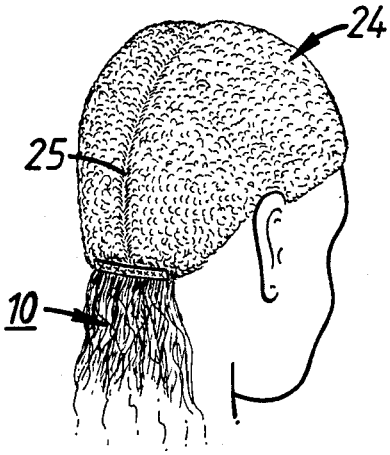

In effect, a head of hair 24 is styled by the use of a plurality of devices corresponding to the apparatus 10, as shown in FIGS. 6 to 12. Initially, a head of hair 24 is provided with a centre parting 25 extending from front to back of the head 24 as shown in FIG. 6. Strands of hair 21 at the base of the scalp then are combed outwardly, as shown in FIG. 7, and a first apparatus 10 is secured thereto, as shown in FIG. 8, in the manner described above with reference to the FIGS. 1 to 5.

Figure 9:
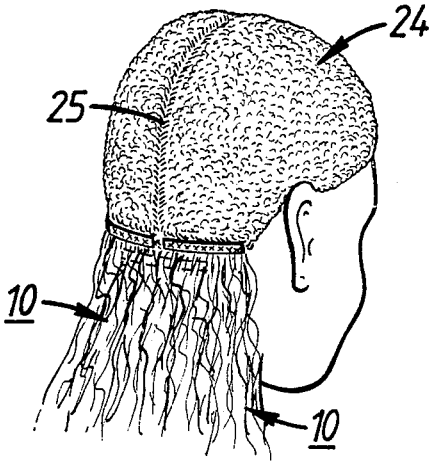
Figure 10:
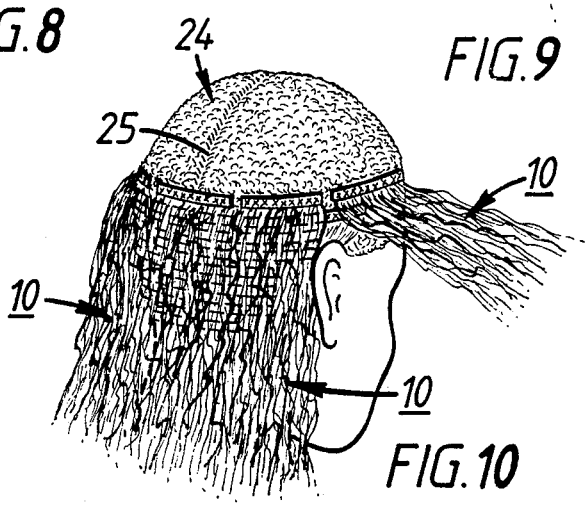
Figure 11:
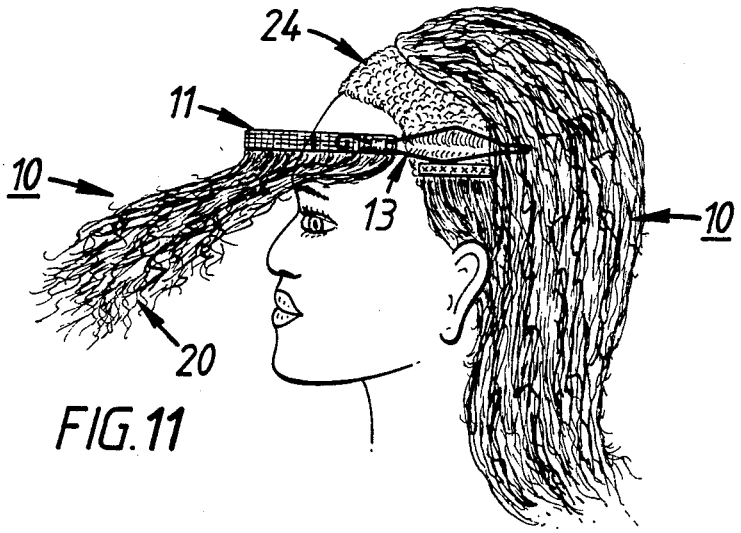
Figure 12:
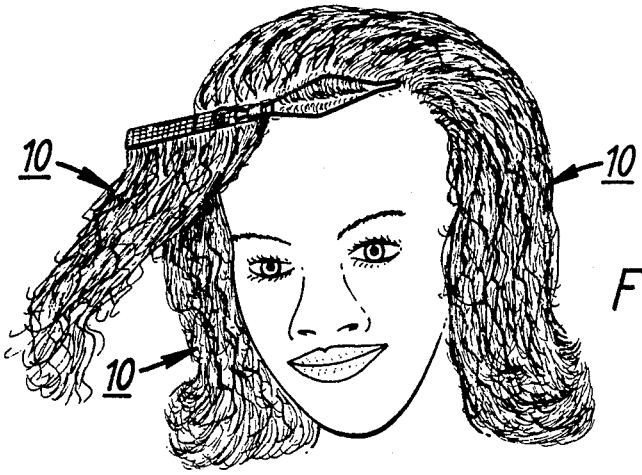

Thereafter, the process is repeated with additional pieces of apparatus 10 on either side of the centre parting 25 rising upwardly of the head 24, as shown in FIG. 9, until weaves of hair have been attached to the head 24 up to a level corresponding to upper portions of the ears of the wearer. The process then is continued in a series of contours extending in a direction from one temple of the head 24, around the crown of the head 24 to the other temple, each piece of apparatus 10 of one contour being offset in a direction of the contour compared with pieces of apparatus 10 in adjacent contours, as shown in FIG. 10. Further pieces of apparatus 10 are applied to the temples of the head of hair 24 and upwardly and forwardly to the forehead, as shown in FIG. 11. A final piece of apparatus 10 attached to a fringe of the head of hair, as shown in FIG. 12.

The complete head of hair 24 with the weaves attached thereto may subsequently be treated in accordance with known techniques, such as perming or streaking.

It will be appreciated that, by means of the method of and apparatus for styling hair in accordance with the present invention, a head of hair which is difficult to style may have firmly attached thereto additional hair which has the characteristic of being more adaptable to being styled. The weaves 20 generally would be real hair cut from the head of another person or other persons. In consequence, when the weaves 20 are applied to a head of hair 24 and are treated, it would not be apparent, without careful scrutiny, that the head of the wearer is carrying the weaves.

It will also be appreciated that the loop 19 and the tape 11 may be formed of a single portion of plastics material whereby the loop 19 and the tape 11 are integral one with another.

I claim:

1. A method of styling hair including the steps of attaching a support for additional hair to be styled to strands of a head of hair by positioning selected strands of the head of hair through the support, closing the support on and engaging the support with the selected strands, rotating the support at least one complete turn to form the selected strands into a wound formation of hair extending completely around the support and securing the additional hair to be wound formation.

2. The method according to claim 1 further comprising the steps of manipulating the support so as to conform substantially with the contour of a scalp underlying the hair to be styled and adjacent to the wound formation of selected strands.

3. The method according to claim 1 wherein the support comprises first and second components, the first component being wound into the formation of selected strands of hair and the second component including a pocket for receiving an end of the first component and wherein said securing step comprises the step of inserting an end of the first component into the pocket of the second component of the support.

4. The method of claim 1 wherein the step of rotating the support further comprises rolling the selected strands up against a scalp supporting the head of hair.

5. The method of claim 1 wherein the first component comprises two engaging portions adapted to close on and engage the selected strands therebetween and wherein adjoining end portions of the first and second components are united before the positioning step and wherein the securing step comprises folding the second component about the united end portions of the first and second components onto the wound formation of hair so as to directly adjoin each of the two engaging portions.

6. Apparatus for styling hair comprising a first component adapted for combining with selected strands of a head of hair to form the selected strands into a wound formation characterised in that the first component comprises two engaging portions adapted to close on and engage the selected strands therebetween and there is provided a second component carrying strands of additional hair to be styled and means for effecting cooperation of the second component and the first component securing the selected strands in the wound formation whereby the strands of additional hair are attached to the head of hair, each of the first and second components being elongate, and having an end portion united with an end portion of the other component such that the second component is generally pivotable about its end portion united with the first component from an open position to a closed position, wherein the second component in the open position exposes the first component for engagement with the selected strands and for rotation to wind the selected strands at least one completely around the first component and form the wound formation, and wherein the second component in the closed position adjoins the first component and secures the selected strands in the wound formation therebetween, the second component being generally pivotable from the open position to the closed position about an axis extending generally perpendicularly to a plane defined by the first and second components in the closed position, the plane extending generally radially through the wound formation between the adjoining first and second components in the closed position.

7. Apparatus as claimed in claim 6 characterized in that the first component is continguous with the second component.

8. Apparatus as claimed in claim 7 characterized in that the first component is integral with the second component.

9. An apparatus in accordance with claim 6 wherein at least the first component is adapted to be manipulated to conform substantially with the contour of a scalp of the head of hair adjacent the wound formation of the selected strands of hair.

10. The apparatus of claim 9 wherein the second component is also at least flexible to accommodate the wound formation.

11. An apparatus in accordance with claim 6 wherein said means comprises a pocket on the second component adapted for receiving part of the first component.

12. The apparatus of claim 6 wherein at least one of the first and second components is at least bendable for accommodating the wound formation between the first and second components.

13. The apparatus of claim 6 wherein the means for securing comprises a member bendable for rotatably uniting the end portions of the first and second components, the bendable member bending generally along the axis to permit the second component to be folded onto the first component and the wound formation.

14. The apparatus of claim 13 wherein the bendable member forms at least one of the two engaging portions of the first component.

15. Apparatus for styling hair comprising a first component adapted for combining with the selected strands of a head of hair to form the selected strands into a wound formation characterized in that the first component comprises a wire in the form of a loop providing two engaging portions adapted to close on and engage the selected strands positioned therebetween and there is provided a second component carrying strands of additional hair to be styled and means for effecting the cooperation of the second component and the first component securing the selected strands in the wound formation whereby the strands of additional hair are attached to the head of hair.

16. An apparatus in accordance with claim 15 wherein the first and second components are planar and wherein the means for effecting cooperation couples the first and the second components together with the planes of the first and second components parallel.

17. Apparatus as claimed in claim 16 characterised in that the means is carried by the second component.

18. Apparatus as claimed in claim 17 characterised in that the said means comprises a formation adapted to receive an end portion of the loop.

19. Apparatus as claimed in claim 18 characterised in that the formation comprises a pocket.

20. Apparatus as claimed in claim 15 characterised in that the said means is carried by the second component.

21. Apparatus as claimed in claim 20 characterised in that the said means comprises a formation adapted to receive an end portion of the loop.

22. Apparatus as claimed in claim 21 characterised in that the formation comprises a pocket.

* * * * *